US007388814B2

(12) United States Patent
Teffenhart et al.

(10) Patent No.: US 7,388,814 B2
(45) Date of Patent: Jun. 17, 2008

(54) THREE-DIMENSIONAL DYE MIGRATION TIME INDICATOR

(76) Inventors: John Teffenhart, 62 Lloyd St., Edison, NJ (US) 08817; Benny S. Yam, 2 Red Coach La., Holmdel, NJ (US) 07733; Raymond S. Brown, 380 Garretson Rd., Bridgewater, NJ (US) 08807; James Mullowney, 33 George St., #11, Lawrenceville, NJ (US) 08648

( * ) Notice: Subject to any disclaimer, the term of this patent is extended or adjusted under 35 U.S.C. 154(b) by 0 days.

(21) Appl. No.: 11/303,323

(22) Filed: Dec. 16, 2005

(65) Prior Publication Data

US 2007/0140068 A1 Jun. 21, 2007

(51) Int. Cl.
*G04F 1/00* (2006.01)

(52) U.S. Cl. ..... 368/327; 116/200

(58) Field of Classification Search ..... 368/327
See application file for complete search history.

(56) References Cited

U.S. PATENT DOCUMENTS 3,962,920 A * 6/1976 Manske ..... 374/102
4,212,153 A 7/1980 Kydonieus et al.
4,629,330 A * 12/1986 Nichols ..... 368/89
4,903,254 A 2/1990 Haas
5,107,470 A * 4/1992 Pedicano et al. ..... 368/327
5,446,705 A 8/1995 Haas et al.
5,602,804 A 2/1997 Haas
5,633,835 A 5/1997 Haas et al.
5,633,836 A 5/1997 Langer et al.
5,699,326 A 12/1997 Haas et al.
5,719,828 A 2/1998 Haas et al.
5,822,280 A 10/1998 Haas
5,862,101 A 1/1999 Haas et al.
5,930,206 A 7/1999 Haas et al.
5,974,003 A * 10/1999 Pedicano et al. ..... 368/327
6,269,764 B1 8/2001 Adamy et al.
6,295,252 B1 9/2001 Holt et al.
6,452,873 B1 9/2002 Holt et al.
6,752,430 B2 6/2004 Holt et al.

* cited by examiner

*Primary Examiner*—P. Austin Bradley
*Assistant Examiner*—Thanh S Phan
(74) *Attorney, Agent, or Firm*—Stephen B. Shear; Frenkel & Associates, P.C.

(57) ABSTRACT

The present invention provides a time indicator and method of use for determining and visually displaying the passage of a predetermined period of time. The time indicator of the present invention comprises a top portion and a bottom portion. The top portion is a multi-layer segment comprising a dye support layer coated with a masking layer, which containing a viewing window therethrough, and a non-curing ink or dye permeable polymer layer containing a migrating agent. The bottom portion is a multi-layer segment comprising a base support layer and a migrating ink or dye printed on the top surface of the base segment. The time indicator apparatus further comprises a removable impervious film or middle layer, which can be removed allowing the top and bottom portions to come into contact with one another, thereby activating the time indicator. The time indicator of the present invention allows one to follow the uniform directional visual dye migration through the viewing window.

20 Claims, 5 Drawing Sheets

THREE-DIMENSIONAL DYE MIGRATION TIME INDICATOR

FIELD OF THE INVENTION

The present invention is generally directed to a timing device for visually determining the passage of a predetermined period of time, which is applicable to a wide variety of consumer products, especially for products which have an extended shelf life and for which it is desirable to know when the product should be replaced or rejuvenated. The timing device can be attached to or incorporated in typical packaging employed for consumer products.

BACKGROUND OF THE INVENTION

Numerous devices are known which provide a visual indication of the passage of a pre-arranged amount of time. For example, such timing devices or time indicators are useful when attached to perishable items for indicating the length of time the items have been on the wholesaler's or retailer's shelf. Foods, photographic materials and other perishable items can be provided with indicators, which after being activated, evidence a visual change, after the passage of a predetermined period of time. Time-temperature indicators are also known which indicate a visual change as a function of both time and temperature.

Current technologies are typically useful only for short time intervals such as days or weeks. They are not useful for longer time intervals (such as months) because the color change occurs by dye diffusion that begins upon activation. Even though the dye may be very slow in migrating to become visible to the viewer, it is difficult for the observer to identify and determine exactly when the image or color indicates that the predetermined time interval has elapsed. The time interval for the image appearance, from white to colored due to the dye migration (say 10-20% tint) is proportional to the predetermined time for which the time indicator has been designed. Thus, for example, in a three month indicator, the time indicator stays pure white for about a month, after which, the indicator starts to change color. After about three months, the observer sees a definite color change of, say 10-20% tint. During the time interval between one and three months, the time indicator is in a "grey area", i.e., "The Grey Time", between expired and unexpired subject to interpretation by the viewer. This lack of a sharp transition time is the problem with known simple dye diffusion systems and indicators.

More specifically, many of the known time indicators, which are generally short-term time indicators, are based on the gradual migration of ink from one substrate through another substrate, i.e. in a path perpendicular to the surface of the substrate. After the ink migrates through the substrate (s) it is viewed on a display surface to thereby indicate that the predetermined time period has elapsed.

Examples of such time indicating systems include the following U.S. patents:

U.S. Pat. No. 4,212,153 to Kydonieus et al. describes a laminated time indicator. In general, the Kydonieus patent discloses a time color indicator having a reservoir layer adhesively attached to an indicator layer. In accordance with the Kydonieus patent, a migrating agent in the reservoir layer migrates through the adhesive layer and the indicator layer to the top or front surface of the indicator layer. The Kydonieus patent also teaches that the reservoir layer is preferably mounted on a barrier layer with an adhesive and release sheet on top of the reservoir layer. The indicator is activated by removing the release sheet and applying an indicator layer to the adhesive layer. Alternatively, the adhesive and release sheet may be associated with the indicator layer. Kydonieus further teaches that the indicator layer is a solid sheet or film of non-porous polymer which allows migration of the chosen agent, and that appropriate indicator layer materials include plasticized PVC, semi-plasticized PVC, rigid PVC, acrylics, polyurethanes and Hytrel® (Dupont Company). The Kydoniesus indicator layer is 2 to 14 mils thick, and may contain plasticizers and stabilizers. The reservoir layer is preferably made from a plastisol, although vinyl chloride/vinyl acetate copolymer, a urethane polymer, a polyolefin, Hytrel® and polyvinyl chloride may be used in forming the reservoir layer. Kydonieus teaches that the reservoir layer should be 1 to 20 mils thick, and is preferably 1 to 5 mils thick. Kydonieus also contemplates that the reservoir layer may be layered down as an ink onto the barrier layer. Specifically, Kydonieus contemplates printing the reservoir composition on mylar or aluminum foil. The Kydonieus patent suggests that appropriate adhesives include thermosetting or thermoplastic pressure-sensitive acrylics or rubbers. The adhesive layer can be preformed and applied as a sheet, applied with another layer such as a release sheet or by coating.

U.S. Pat. No. 5,364,132 to Haas et al. describes a method of assembly and activation of a reusable self-expiring Security Identification Badge. The Badge includes a base substrate having a void indicia area, an ink substrate having an expired indicia area of a soluble ink and an adhesive surface, and an overlay substrate having an ink dissolver and a display surface. When the Security I.D. Badge is issued, the inked substrate is attached to the base substrate, the inked substrate covering the void indicia area. The overlay substrate is then placed over and attached to the inked substrate, the ink dissolver in contact with the soluble ink of the ink substrate. The ink dissolver of the overlay substrate contacts and coacts with the soluble ink of the inked substrate to dissolve the ink and allow the ink to migrate through to the overlay substrate to the display surface, where it can be visually perceived, in a preselected time interval.

U.S. Pat. No. 5,446,705 to Haas et al describes a time indicator that changes color or produces an image or information after a specific time interval. The time indicator includes a base substrate with colored dye deposited on a first surface; and a substrate having an adhesive on a first surface thereof, the adhesive positioned at discrete locations on the first surface of the substrate. The substrate and the base substrate are put into adhesive contact. The adhesive contacts and coacts the colored dye to dissolve the dye and permit the dye to migrate through the adhesive to cause a color change visible through the substrate. The discrete adhesive inhibits lateral migration of the dye to preserve the image or information of the dye in a clear and/or understandable condition.

U.S. Pat. No. 5,602,804 to Haas describes a time indicator device with a display layer with at least one defined display region therein. A migration layer is provided which overlies and is attached to the display layer. The migration layer has at least one migration region therein and in use each migration region is in contact with at least one display region. An activation layer is provided which has at least one defined activation region therein. The activation region includes a migrating agent capable of migrating laterally through the migration region. When the activation layer overlies the migration layer, each activation region overlies at least one migration region. The migration region connects each activation region with at least one display region which is laterally distal from the activation region. In use and in order to activate the device the activation layer and migration layer are adhesively attached to each other. When the activation layer is contacted with and overlies the migration layer, each activation region contacts at least one migration region. Upon contact the migrating agent is activated to migrate laterally from the activation region through the migrating region to at least one display region in a predetermined amount of time to cause an indication in the display region that the predetermined amount of time has elapsed. Preferably, the device has a plurality of defined display regions, defined activation regions and/or migration regions to provide a means for adjusting the predetermined time, adjusting for environmental conditions and to provide a plurality of elapsed times.

U.S. Pat. Nos. 5,715,215 and 5,873,606 to Haas et al describe an identification badge that comprises a base coated with an adhesive protected by release paper. This badge is assembled by removing the release paper, placing an identification card into contact with the adhesive, and then attaching a fastener through a slot in the base of the badge. Various fasteners may be used to attach this badge to wearer's apparel. The identification card can also be mounted so that the identification indicia is placed against a transparent, adhesive and viewed through a transparent base. A timing indicator can be incorporated into the badge so as to show the expiration of the badge after a selected period of time.

U.S. Pat. No. 5,719,828 to Hass et al. describes a patterned indicator which contains latent information. The patterned indicator includes a first substrate having first and second surfaces, the first surface having a uniform pattern printed of an ink thereon. A second transparent substrate having first and second surfaces is also provided. An adhesive activator is provided on the first surface of the second substrate. The indicator is activated by placement of the first surfaces of the first and second substrates into adhesive contact such that the ink and adhesive activator coact to cause the ink pattern to gradually bleed and blend together to cause a change visually perceptible through the transparent substrate in a selected time interval. A preferred embodiment of the invention is a parking permit, while other preferred embodiments include transit tickets, admission tickets, time passage indicators for other applications. Also within the scope of this invention are patterned indicators printed with inks having multiple sensitivities for indicating tampering with goods in packages sealed with such indicators.

U.S. Pat. No. 5,785,354 to Hass describes an identification band is provided which includes an elongated band having an outer surface, an inner surface and first and second ends. A first chemical composition, e.g., a soluble ink, is distributed on the outer surface of the band proximate the first end. A display region is disposed in the band proximate the second end. A second chemical composition, e.g., an adhesive ink activator is distributed on the inner surface of the band overlying the display region proximate the second end. When the band is wrapped around an object, e.g., a user's wrist, with the outer surface exposed, the outer surface of the first end and the inner surface of the second end overlay and are in contact, preferably in adhesive contact, with each other. The first and second chemical compositions coact with each other to cause a visually perceptible change in the display region after a predetermined time interval.

U.S. Pat. No. 5,822,280 to Haas describes a time indicator that includes a front layer and a back layer, each having an inner and outer surface. The front layer has a display region on its outer surface. An adhesive means is provided on the inner surface of the front or back layer for adhesively attaching the front layer and back layer to each other. An opaque viewing layer is included on the front or back layer and an activation agent is provided on the other layer. One surface of the opaque viewing layer is viewable from the display region when the front and back layers are adhesively attached to each other. A dye that is substantially non-migrating through the opaque viewing layer, overlies the other surface of the opaque viewing layer. When the inner surfaces of the front and back layers are contacted with each other, the adhesive means adhesively attaches the front and back layers to each other and activates the activation agent. The activation agent migrates to the opaque viewing layer in a predetermined period of time to be absorbed therein. Such absorption activates the dye to enable it to migrate through the opaque viewing layer toward the other side causing an indication in the display region that the predetermined amount of time has expired. Optionally, the activation agent contacts the dye to, for example, solubilize the dye to enable it to migrate through the opaque viewing layer. Preferably, the activating agent is a plasticizer that is absorbed into the polymeric opaque viewing layer. At a critical concentration of the plasticizer in the viewing layer, the dye is rapidly absorbed into the viewing layer, passing through the viewing layer to the other surface thereof where it becomes visible through the clear display region on, for example, the white background of the viewing layer.

U.S. Pat. No. 5,930,206 to Haas describes a time indicator comprising a front part and a rear part, the rear part comprising an ink pattern layer overlaying a rear support member. The front part comprises a transparent front support layer, and an opaque adhesive layer having a front ink display surface, the adhesive layer capable of dissolving the ink pattern on the rear part, whereby contacting the front part with the rear part by applying the opaque adhesive layer onto the ink pattern layer activates the dissolution and migration of ink in a selected time interval from the ink pattern layer, through the opaque adhesive layer to the front ink display surface for viewing through the transparent front support layer.

U.S. Pat. No. 5,957,458 to Haas et al describes a game card having a hidden game image thereon that is developed over a predetermined period of time. The game card includes a front part and a rear part. The rear part has a migrating ink pattern layer overlaying a rear support member to form a game image. An non-migrating printed pattern layer overlays the rear support member to form a confusion pattern to hide the image. The front part includes a front support layer having an adhesive layer on one side and a front ink display surface on the other side. The adhesive layer is capable of causing the migrating ink pattern to migrate upon contact therewith. Thus when the front part is contacted with the rear part by applying the adhesive layer onto the ink pattern layer, the adhesive layer activates the migration of ink in a selected time interval from the ink pattern layer, through the adhesive layer to the front ink display surface for viewing the game image. Typically, the game image is capable of informing the user whether the game card is a winning card or a losing card.

U.S. Pat. No. 5,974,003 to Pedicano et al. describes a time color indicator that includes a base layer segment having a transparent impermeable layer, a substantially non-curing opaque coating, and a release sheet. A portion of the uncoated surface of the transparent layer bears a printed area including a camouflage pattern printed with non-migrating ink and a message segment printed with migrating ink. An indicator layer segment includes a transparent impermeable layer, a substantially non-curing opaque coating, and a release sheet partially folded back to form a finger gripping tab and expose an indicator layer coating portion which contacts and adheres to the base layer adjacent the printed area. The time color indicator is activated by pulling the finger tab to remove the release sheet, causing the indicator layer coating to cover and contact the printed area, with the message segment migrating through the indicator layer coating.

One of the problems associated with all of the foregoing devices is that they are difficult to adjust for a selected period of time. Adjustment often involves experimentation with many types of inks, solvents, wicks, etc. to prepare a device, which can operate under the conditions expected. Additionally, very few of these devices can indicate the relative length of time that has elapsed since the device was activated, i.e., it is difficult to determine what fraction of the predetermined period of time has elapsed. Further, none of these devices are suitable for measuring a relative long time period. Most of the prior art devices gradually change color over a relatively short period of time and involve, at best, a guess on how much time has elapsed. When this is combined with the possible variations in temperature, humidity, etc. that may exist in the environment of the time indicator, the viewer has very little confidence that he is close to the expiration time of the device.

It is an object of this invention to provide a time indicator device, which can provide the user with a clear indication of the passage of relatively long time intervals.

SUMMARY OF THE INVENTION

The present invention is directed to a time indicator and method of use for determining and visually displaying the passage of a predetermined period of time. In accordance with the present invention, the time indicator comprises a top portion or display segment and a bottom portion or base segment. The time indicator apparatus further comprises a removable impervious film or middle layer, which can be removed to activate the time indicator. The time indicator of the present invention allows for uniform directional visual dye or ink migration in three-dimensions from the base segment to a desired endpoint in the display segment. The resulting color change in top portion or display segment can be viewed and monitored through a viewing window located therein as the dye or ink migrates across the viewing window. The top portion or display segment and bottom portion or base segment of the present invention comprise multi-layered configurations such that the dye or ink migrates both vertically and horizontally into and through the top portion or display segment.

DETAILED DESCRIPTION OF THE INVENTION

Figure 1:
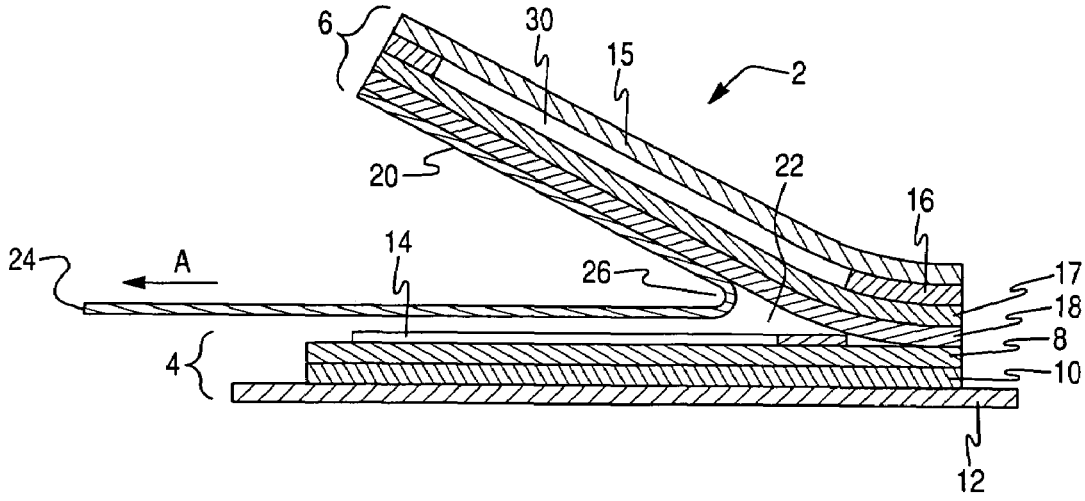
FIG. 1 is a side cross-section view of a time indicator constructed in accordance with the preferred embodiment of the invention.

The present invention is generally directed to a shelf life indicator hereinafter referred to as a "time indicator" or "change indicator" for determining the remaining shelf life or for signaling the end-of-life of a consumer product and visually displaying the same. The time indicator of the present invention has applicability to a wide range of consumer products and packages containing the same and typically is applied to products, which have a relatively long shelf life.

In accordance with the present invention, there is provided a time indicator for determining and visually displaying the passage of a predetermined period of time comprising: (1) a multi-layered top portion or display segment comprising a color coating (e.g., silver coating) and/or an opaque coating containing a viewing window therethrough, through which progression of a migrating ink or dye can be monitored, a clear impermeable layer and a non-curing ink or dye permeable polymer layer containing an ink or dye migrating agent, optionally a top transparent protective top layer may also be included; (2) a multi-layered bottom portion or base segment comprising a base support layer and a migrating ink or dye printed on the top surface of the base segment, wherein said dye or ink is activated by the non-curing ink or dye permeable polymer layer containing an ink or dye migrating agent; and (3) a removable impervious film that prevents the migrating ink or dye of the base segment from coming into contact with the activating non-curing ink or dye permeable polymer layer of the display segment, and which can be removed to activate the time indicator.

The "predetermined period of time" after which the indicator expires, may be varied and controlled, for example, by varying the geometry, composition and/or concentration of the printed migrating ink or dye, the thickness and polymer composition of the layers, the absorption characteristics of the layers, the concentration of the ink or dye migrating agent, and the temperature of the surrounding environment. All of which can be empirically determined by one of skill in the art. For example, the time period from initiation and activation of the time indicator to the visually perceptible event can depend upon the migration speed of the migrating ink or dye, which in turn is dependent upon the concentration of the ink or dye migrating agent in the non-curing ink or dye permeable polymer layer, the thickness of the solid non-porous indicator layer, the molecular weight of the migrating ink or dye, the chemical functionality of the migrating ink or dye and the physicochemical properties (eg. crystallinity, polarity, functional groups, etc.) of the polymer used as the non-curing ink or dye permeable polymer. Mathematically, the molecular migration process or permeation rate is governed primarily by solubility of the permeate (eg. ink, plasticizers, etc.) and the diffusion rate in the polymer, described by Henry's Law and Fick's Law, see "Diffusion in Polymers," Crank and Park, Editors, Academic Press, New York, and "The Permeability of Polymers to Gases, Vapours and Liquids" by Richards, ERDE (Ministry of the Defense), Technical Report No. 135, March 1973 (NTIS No. AB-767,627). Typically, the predetermined period of time can range from weeks to months, or in some cases even years. Preferably, the predetermined period of time ranges from 1 week to 1 year, more preferably from 1 month to 6 months. The timing can vary based on the polymers used and the migrating ink or dye used.

In accordance with the present invention, the top portion or display segment optionally contains a transparent protective top layer. When used the transparent protective top layer is the top most layer of the top portion or display segment and is a transparent protective layer generally comprising a clear impermeable web, such as an acetate or polyester film. However, any known clear impermeable web or transparent polymer film can be used. Optionally, the transparent protective top layer may be bottom coated with a pressure sensitive adhesive to hold the various layers together. Under the transparent protective top layer, the top portion or display segment includes a clear impermeable layer or display support layer. The clear impermeable layer or display support layer generally consists of a transparent polymer layer, such as an acetate or polyester film. Again, any known clear impermeable web or transparent polymer film can be used. In one embodiment, the clear impermeable layer or display support layer is top coated with a color print coating (e.g., a high opacity silver ink) and/or an opaque coating (e.g., a polypropylene coating). In general, any known color print coating or opaque coating can be used. The color print and/or opaque coating or layer is coated over the entirety of the clear impermeable layer or display support layer, with the exception of a viewing window area (or non-coated area), and hides or masks the dye or ink migration through the underlying layers. The viewing window through the color print and/or opaque layer allows for the user to view or monitor uniform directional visual dye or ink migration in three-dimensions to a desired endpoint in the underlying layers. In one embodiment the viewing window can be a rectangular window, and the dye or ink migration can proceed from the bottom of the rectangular window to the top of the rectangular window. In another embodiment, the view window can be a circular disk shaped viewing window, and the dye or ink migration can proceed towards the center of the circular disk. In yet another embodiment, the color print and/or opaque coating may be overcoated with a printed graphic or label layer. Any labeling or graphic design or pattern can be applied. This additional layer provides further opacity, and thus, increases the hiding or masking of ink migration through the underlying layer. The printed graphic or label layer must also contain a viewing window therethrough.

The clear impermeable layer or display support layer and color print and/or opaque coating overlies a non-curing ink or dye permeable polymer layer, which contains an ink or dye migrating agent. During activation, discussed in more detail hereinbelow, the migrating agent can act to enhance the dye or ink migration, thereby allowing the dye or ink to migrate both vertically and horizontally into and through the non-curing ink or dye permeable polymer layer. The non-curing ink or dye permeable polymer layer can optionally contain an opaqueing agent. The opaqueing agent can be included to create a contrasting background, thus, allowing the dye or ink to be visualized more easily. Generally, any known opaqueing agent can be used, e.g., a non-curing vinyl-titanium dioxide mixture, which allows the polymer layer to remain permeable to the migrating ink or dye.

Almost any known non-curing ink or dye permeable polymer can be used. In a preferred embodiment, the non-curing ink or dye permeable polymer layer also acts as an adhesive layer. In this embodiment, the non-curing ink or dye permeable polymer layer or adhesive polymer layer adhesively attaches the top portion or display segment and the bottom portion or base segment to each other. In general, any known adhesive polymer, which is receptive to the dye or ink can be used. The adhesive can be a thermosetting or thermoplastic pressure-sensitive acrylic or rubber. Exemplary adhesives may include, but are not limited to, Duro-Tak 6112 or Duro-Tak LS5068 from National Starch and Chemical Co., Bridgewater, N.J., as well as other adhesives from Avery Company, Fasson Films Divisions, Painesville, Ohio.

Typically, the non-curing ink or dye permeable polymer layer includes therein, admixed with the non-curing ink or dye permeable polymer an activation agent or migrating agent. The migrating agent enhances the ability of the ink or dye to migrate, thereby enabling the ink or dye to more easily migrate into and through the non-curing ink or dye permeable polymer layer. Generally, any known activation or migrating agent can be used. For example, the migrating agent can be an organic plasticizer, such as Plasthall P-550, Plasthall Trioctyl Trimelletate, or Paraplex G-25 from C.P. Hall Company.

In another embodiment, a rubber or acrylic based pressure sensitive adhesive polymer can be used with an "opaqueing agent", for example titanium dioxide, dissolved in the adhesive polymer in, for example, concentrations of about 1% to about 40%. Color pigments can also be added to the adhesive polymer to make it any desired color, for example, white to contrast with the dye or ink. For example, the non-curing ink or dye permeable polymer layer mixture may contain about sixty four percent (64%) by weight plasticizer, such as the polyester plasticizer available under the tradename "ADMEX" from Huls America, Inc., Piscataway, N.J., twenty percent (20%) by weight titanium dioxide ($TiO_2$), and sixteen percent (16%) by weight polyvinyl chloride resin.

The non-curing ink or dye permeable polymer layer may also comprise solid sheets or films of a non-porous polymers, which allows for migration of the ink or dye into and through the sheet or film to its opposite surface. Examples of such polymers include plasticized PVC (polyvinyl chloride), semi-plasticized PVC, rigid PVC, acrylics, polyurethanes and Hytrel® (Dupont Company), and polymers and lamination techniques described in U.S. Pat. No. 3,075,938, incorporated herein by reference. The thickness of the indicator layer can be adjusted depending upon the time period to be indicated and the migrating ink or dye. A typical non-curing ink or dye permeable polymer layer can be a mixture of PVC and 10% to 30% titanium dioxide. In general, the thickness will be up to about 14 mils, such as, for example, from about 2 to 14 mils.

The non-curing ink or dye permeable polymer formulation depends, to a large degree, on the thickness, type and composition of the non-curing ink or dye permeable polymer layer. The rate of absorption of the inks can be greatly enhanced by adding a variety of liquid organics or plasticizers to the non-curing ink or dye permeable polymer layer to thereby decrease the time required for the ink or dye to migrate into and through the non-curing ink or dye permeable polymer layer. Still further, depending on the specific organic, the rate of image development can be enhanced by a hundred-fold. A plasticizer, for example, may be used to provide the aforesaid enhancements.

In accordance with the present invention, the time indicator further comprises a bottom portion or base segment. The bottom portion or base segment contains a base impermeable support layer, which can be clear or opaque. The base impermeable support layer can be any impermeable clear or opaque film such as a polyester film or a polypropylene film. A portion of the topside of the bottom impermeable support layer is printed with a migrating ink or dye. In another embodiment, the bottom portion or base segment may further comprise an adhesive layer and a base segment release sheet.

In general, any organic dye or ink can be used in the present invention. Dyes which can be used include Eastman Dye FFBL #8272 (Red) and Eastman #373 (2',7'-dichlorofluorescein), referred to in Eastman catalog JJ-196. Dyes that are extremely bulky with respect to molecular structure or are highly polymeric will show a reduced migration speed.

Exemplary inks for use with this invention can include inks from Gans Ink Company, Los Angeles, Calif. In particular, Pyroscript Sublimation Inks, e.g. Ink Nos. 57977, 57976; Heat Transfer Inks, Turn-A-Bout, Sunrise Process, Sunburst Process and Turn-A-Bout R.S. Series inks. Sublimation and heat transfer type inks are generally low molecular weight dyes that can bleed.

The amount of dye or ink used in the time indicator will depend upon the intensity of the color desired, the thickness of the non-curing ink or dye permeable polymer layer, desired time period for the device to measure and the ability of the non-curing ink or dye permeable polymer layer to receive and hold the dye or ink. A further consideration would be the visual appearance of the non-curing ink or dye permeable polymer layer before migration as compared to the appearance after migration. For example, if high contrast is afforded by the visual system such as by the migration of a black dye or ink contrasted by a white opaque non-curing ink or dye permeable polymer layer, the amount of dye or ink needed may be lowered.

In accordance with one embodiment of the present invention, the topside of the base impermeable support layer is printed with a "V" shaped dye pattern. In this embodiment, the viewing window in the display segment comprises a rectangular un-masked window. This design permits the dye or ink, upon activation, to migrate from the "V" pattern, which can be viewed as progression in the rectangular window over time. When the middle release layer, a removable impervious film, is removed the non-curing ink or dye permeable polymer layer comes into contact with the ink or dye. A migrating agent contained in the non-curing ink or dye permeable polymer layer enhances the vertical and lateral migration of the dye or ink into and through the non-curing ink or dye permeable polymer layer. The clear impermeable layer of display support layer overlying the non-curing ink or dye permeable polymer layer prevents the dye or ink from migrating out of the non-curing ink or dye permeable polymer layer. Furthermore, as discussed above, the clear impermeable layer is top coated with a color print and/or opaque coating, which hides or masks the migration of the dye or ink into and through the underlying non-curing ink or dye permeable polymer layer. The color print and/or opaque coating is coated over the entire clear impermeable layer with the exception of a rectangular viewing window through which progression of the dye or ink can be monitored.

In another embodiment, the topside of the base impermeable support layer is printed with a single ring or one or more ring (i.e., concentric rings) shaped ink or dye patterns. In this embodiment, the viewing window in the display segment comprises a circular un-masked window. This design permits dye permeation upon activation to migrate to the center of the ring pattern, which can be viewed as progression in the circular window over time. When the middle release layer is removed the migrating agent enhances the vertical and lateral migration of the dye or ink into and through the non-curing ink or dye permeable polymer layer. The clear impermeable layer of display support layer overlying the non-curing ink or dye permeable polymer layer prevents the dye or ink from migrating out of the non-curing ink or dye permeable polymer layer. The clear impermeable layer is top coated with a color print and/or opaque coating over the entire clear impermeable layer with the exception of a circular viewing window through which progression of the dye or ink can be monitored.

The time indicator of the present invention further comprises a middle layer or activation release sheet. A first portion of the activation release sheet is folded back to form a finger gripping tab and a second portion is adhered to the non-curing ink or dye permeable polymer layer. The time indicator can be activated by pulling the finger tab to remove the release sheet, causing the non-curing ink or dye permeable polymer layer to cover and contact the printed dye or ink.

Optionally, the time indicator also includes a base segment release paper, which may be removed from the base segment, exposing the bottom side of the non-curing ink or dye permeable polymer layer, so that the time indicator can be adhered to a desired substrate, such as a baking soda box.

The time indicator of the present invention can be better exemplified by reference to the following embodiments and figures.

FIG. 1 is a cross-section side view of the preferred time indicator 2 prior to activation. The time indicator 2 includes a base segment 4 and a display segment 6. The base segment 4 comprises a clear or opaque base impermeable support layer or base support layer 8, and an adhesive layer 10. The adhesive layer is subsequently covered with a base segment release sheet 12, which can be removed so the time indicator 2 can be adhered to a desired substrate. A portion of the other surface of impermeable base support layer 8 contains a printed migrating ink or dye area 14. The printed migrating ink or dye area 14 can comprise a variety of different shaped patterns and/or sizes, e.g., the printed migrating ink or dye area 14 can be a pattern in the shape of a V 14 (see FIG. 2). Numerous migrating dyes, including dyes known as transfer dyes, may appropriately be mixed with conventional printing inks to obtain the desired migrating printed dye or ink. Appropriate dyes are disclosed in the foregoing Kydonieus U.S. Pat. No. 4,212,153, incorporated herein by reference, and appropriate inks include conventional printing inks, such as standard RMS colors available, inter alia, from Gotham Inks. In another embodiment, "POLYCRON CERISE NA" (1-amino-4-hydroxy-2-phenoxy-9,10-anthracenedione) from Atlantic Chemical Corporation, Nutley, N.J., can be used as a migrating agent mixed with conventional printing ink. The same ink without migrating dye is used to print the camouflage portion of the printed area.

The display segment 6 comprises a non-curing ink or dye permeable polymer layer 18, which contains a migrating agent. The migrating agent enhances the migration of the ink or dye into and through the non-curing ink or dye permeable polymer layer 18. A useful non-curing ink or dye permeable polymer layer mixture may contain about sixty four percent (64%) by weight plasticizer, such as the polyester plasticizer available under the tradename "ADMEX" from Huls America, Inc., Piscataway, N.J., twenty percent (20%) by weight titanium dioxide ($TiO_2$), and sixteen percent (16%) by weight polyvinyl chloride resin. The foregoing vinyl-titanium dioxide mixture has been found to provide the desired opacity and non-curing adhesive properties in a coated layer, which is permeable to an appropriate migrating ink or dye. The display segment further comprises a clear impermeable top layer or display support layer 17, which is coated with a color print and/or opaque layer 16 (e.g., a high opacity silver ink). The color print and/or opaque layer 16 is coated over the entirety of the clear impermeable layer or display support layer 17, except for a viewing window area 30 (see FIGS. 2 and 3). The color print and/or opaque layer 16 acts to hide or mask the ink or dye, which has migrated into a non-curing ink or dye permeable polymer layer 18 and has not yet reached the viewing window area 30. Once the ink or dye migrates into the viewing window area 30 ink or dye migration can be displayed and followed. In one embodiment, the display segment can further comprise a graphic or label layer (not shown) coated over top of the color print and/or opaque layer 16. Optionally, the display segment can further comprise a transparent protective top layer 15, which is located over the color print and/or opaque layer 16 and is the top most layer of the display segment 6.

The time indicator 2 also contains a middle layer or activation release sheet 20, which separates the display segment 6 from the base segment 4. The activation release sheet 20 is partially removed or peeled back, and the exposed area 22 of non-curing ink or dye permeable polymer layer 18 contacts and adheres to a portion of the surface of base segment 4, at base impermeable support layer or base support layer 8, adjacent printed migrating ink or dye area 14. The partially peeled-back top layer release sheet forms a gripping tab 24. To activate the time color indicator, gripping tab 24 is pulled in the direction of arrow "A" to peel the remainder of the activation release sheet 20 from display segment 6. Because display segment 6 is secured to base segment 4 at base impermeable support layer or base support layer 8, display segment 6, more specifically the non-curing ink or dye permeable polymer layer 18, becomes disposed over printed migrating ink or dye area 14 (see FIG. 4) activating the time indicator 2 as described hereinabove.

As discussed above, base segment 4 comprises a base impermeable support layer or base support layer 8. As shown, base segment 4 further comprises a base adhesive layer 10 and release sheet 12. The top or upper surface of the base impermeable support layer or base support layer 8 is partially covered by a printed migrating ink or dye area 14. The printed migrating ink or dye area 14 comprises a printed pattern or shape of a migrating ink or dye. As mentioned above, the printed migrating ink or dye area 14 area can comprises a variety of different shaped patterns and sizes, e.g., the printed ink can be in a patter in the shape of a V, as shown here. Base impermeable support layer or base support layer 8 should be a barrier to the migrating ink or dye. In one embodiment, base impermeable support layer or base support layer 8 preferably constitutes a clear polyester layer, e.g., a "Mylar" (E.I. duPont de Nemours & Co.).

Figure 2:
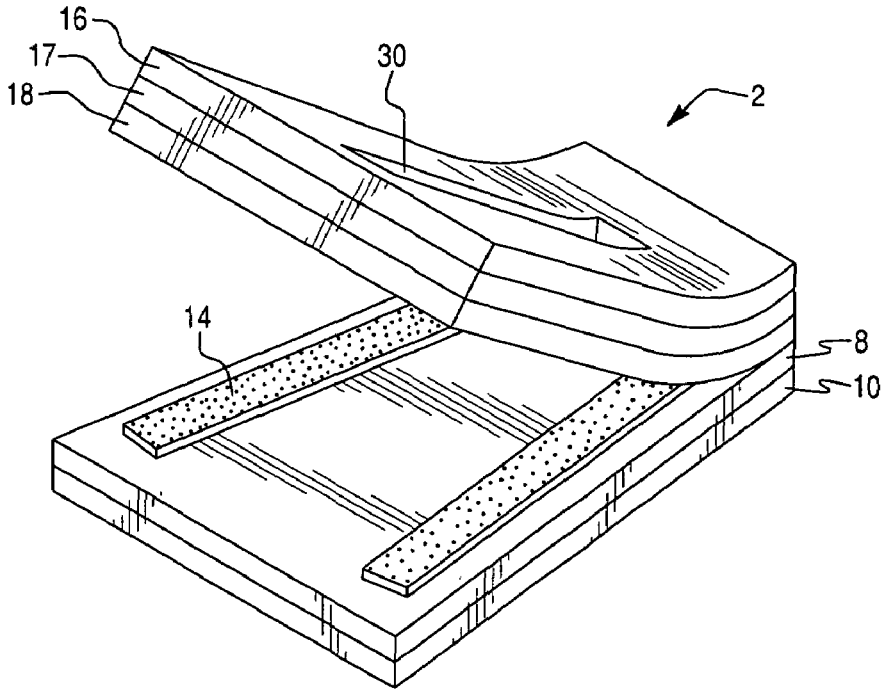
FIG. 2 is a perspective view of a time indicator constructed in accordance with the invention attached to a receiving surface prior to activation.

FIG. 2 is a perspective view of the time indicator 2 in accordance with one embodiment of the present invention. As shown, release sheet 12, from base segment 4, has been removed so base adhesive layer 10 can be adhered to a receiving surface (not shown). Time indicator 2 is again shown in the pre-activation position. However, release sheet 20 has been removed in FIG. 2 clearly showing the printed migrating ink or dye area 14 in a V shaped pattern.

FIG. 2 also illustrates display segment 6 disposed in a first, pre-activation position with non-curing ink or dye permeable polymer layer 18 partially exposed and in adhering contact with base segment 4 at contact area 22 adjacent printed migrating ink or dye area 14. As shown here, activation release sheet 20 (see FIG. 1) has been removed and the time indicator 2 is in the pre-activation position. The time indicator 2 is in pre-activation position because display segment 6, more specifically the non-curing ink or dye permeable polymer layer 18, is not in contact with base segment 4, or more specifically printed migrating ink or dye area 14. Clear impermeable layer or display support layer 17 is disposed above non-curing ink or dye permeable polymer layer 18 and is coated with a color print and/or opaque layer 16. Clear impermeable layer or display support layer 17 is preferably a clear impermeable sheet, e.g., "Mylar," and is coated with a color print and/or opaque layer 16, e.g., a high opacity silver ink. As described above, the color print and/or opaque layer 16 is coated over the entirety of the clear impermeable layer or display support layer 17, except for viewing window area 30. The transparent protective top layer 15 of FIG. 1 has been removed so that the viewing window area 30 can be clearly seen. Optionally, the display segment can further comprise a graphic or label layer (not shown) coated over top of the color print and/or opaque layer 16.

Figure 3:
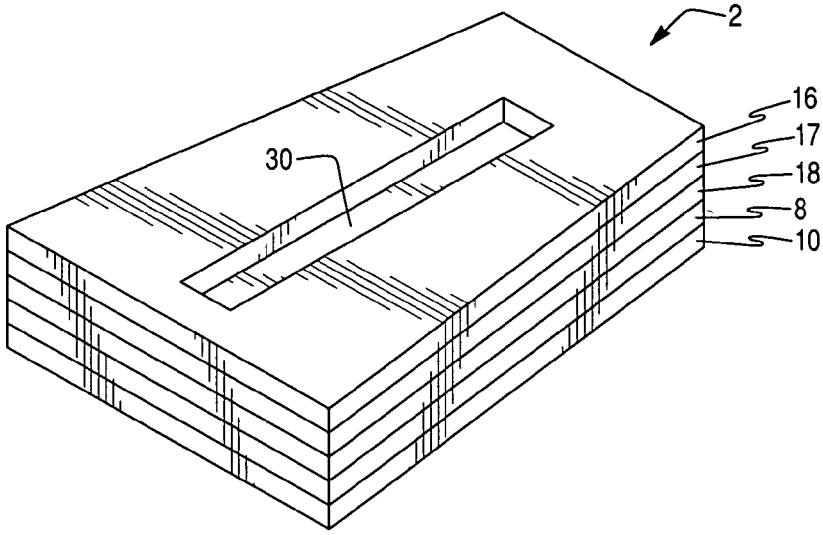
FIG. 3 is a perspective view of a time indicator of FIG. 2 after activation.

FIG. 3 is a perspective view of the time indicator 2 after activation. The base segment release sheet 12 (see FIG. 1), from base segment 4, has been removed so that base adhesive layer 10 can be adhered to a receiving surface (not shown). As shown in FIG. 3, the time indicator 2 is shown with the activation release sheet 20 (see FIG. 1) removed. In the activated position, as shown here, display segment 6, and, more specifically, non-curing ink or dye permeable polymer layer 18, contacts and adheres to the base segment 4, more specifically the base impermeable support layer or base support layer 8, with non-curing ink or dye permeable polymer layer 18 contacting the printed migrating ink or dye area (not shown). Clear impermeable layer or display support layer 17 is disposed above non-curing ink or dye permeable polymer layer 18 and is coated with a color print and/or opaque layer 16 over the entirety of clear impermeable later or display support layer 17, except for viewing window area 30.

Figure 4:
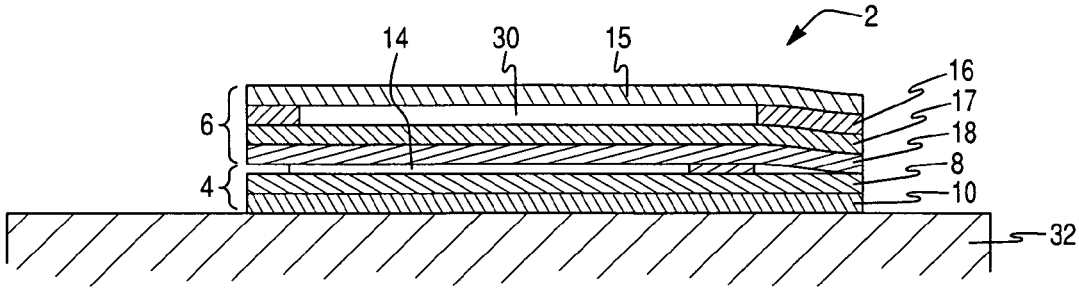
FIG. 4 is a side cross-section view of a time indicator of FIG. 3.

FIG. 4 is a side cross-section view of the indicator of FIG. 3, showing in exaggerated detail display segment 6 overlying printed migrating ink or dye area 14 with non-curing ink or dye permeable polymer layer 18 in contact with the printed migrating ink or dye area 14. As shown, base segment release sheet 12 has been removed and base segment 4 is adhered to a receiving surface 32 via adhesive layer 10. The printed migrating ink or dye area 14 is a migrating ink or dye which will migrate both vertically and horizontally into and through the non-curing ink or dye permeable polymer layer 18. Clear impermeable layer or display support layer 17 prevents the ink from migrating out of the non-curing ink or dye permeable polymer layer 18. As previously described, clear impermeable layer or display support layer 17 is coated with a color print and/or opaque layer 16. The color print and/or opaque layer 16 is coated over the entirety of clear impermeable layer or display support layer 17, except for viewing window area 30. Ink or dye migration can be viewed and monitored through viewing window 30. A transparent protective top layer 15 is located over the color print and/or opaque layer 16 and is the top most layer of the display segment 6.

The clear impermeable layer or display support layer 17, transparent protective top layer 15 and base impermeable support layer or base support layer 8 of the present invention can be made of transparent impermeable polyester, such as clear "Mylar" film available from E.I. duPont de Nemours & Co. In the context of the present invention, the term "impermeable" as used to describe the clear impermeable layer or display support layer 17, transparent protective top layer 15 and base impermeable support layer or base support layer 8 shall be understood to mean that layers 17, 15 and 8 have a molecular structure, which effectively prevents passage of the migrating ink or dye into or through these layers. Thus, base impermeable support layer or base support layer 8 effectively prevents the migrating ink or dye contained in printed migrating ink or dye area 14 from migrating downwardly. The clear impermeable layer or display support layer 17 similarly prevents migration of the migrating ink or dye from non-curing ink or dye permeable polymer layer 18 into any layers above the clear impermeable layer or display support layer 17.

In use, the time indicator 2 of the present invention is applied to a receiving surface 32 (see FIG. 4), such as a baking soda box, by removing the base segment release sheet 12 and adhering the apparatus to the receiving surface 32 as depicted in FIG. 4. To activate the time indicator 2, gripping tab 24 is pulled in the direction of arrow A (see FIG. 1) to remove the activation release sheet 20 and cause non-curing ink or dye permeable polymer layer 18 to contact and adhere to base impermeable support layer or base support layer 8 and printed migrating ink or dye area 14. After activation, a migrating agent contained in non-curing ink or dye permeable polymer layer 18 enhances migration of the printed migrating ink or dye area 14, thus allowing the ink or dye to migrate into and through the non-curing ink or dye permeable polymer layer 18. The clear impermeable layer or display support layer 17, which is coated with a color print and/or opaque layer 16 hides or masks ink migration to a viewer except in a non-coated viewing window area 30. Ink or dye migration into and through non-curing ink or dye permeable polymer layer 18 can be viewed or monitored as uniform directional visual dye migration in three-dimensions to a desired endpoint though the viewing window area 30 (see FIG. 3).

Figure 5A:
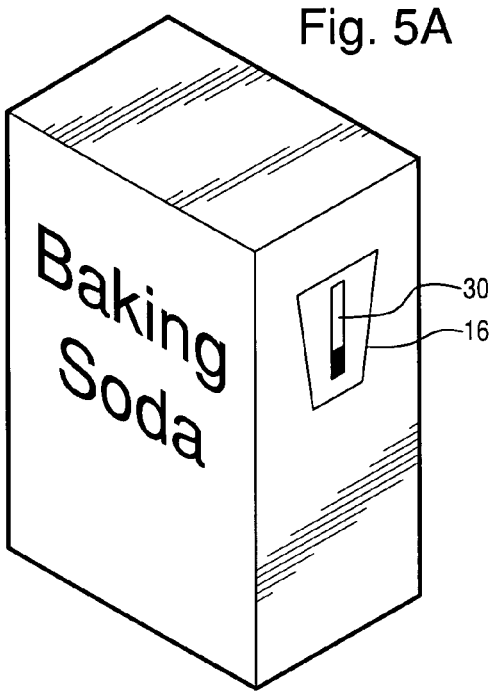
FIG. 5A-C is a series of schematics showing ink or dye progression at various stages of migration, as seen through a rectangular viewing window of a time indicator in accordance with one embodiment of the present invention.
Figure 5B:
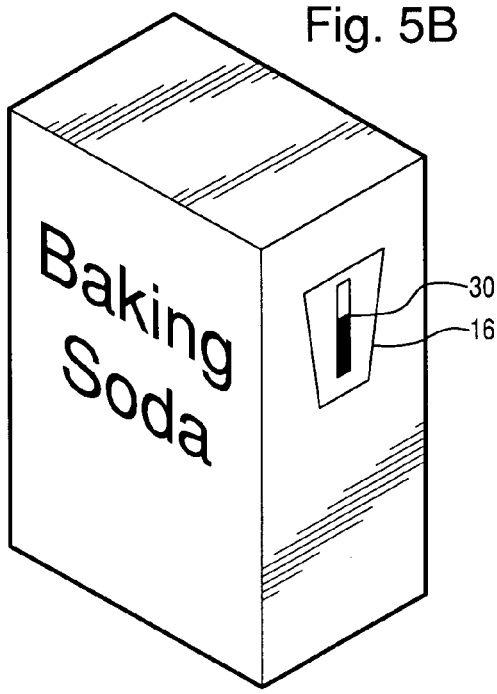
Figure 5C:
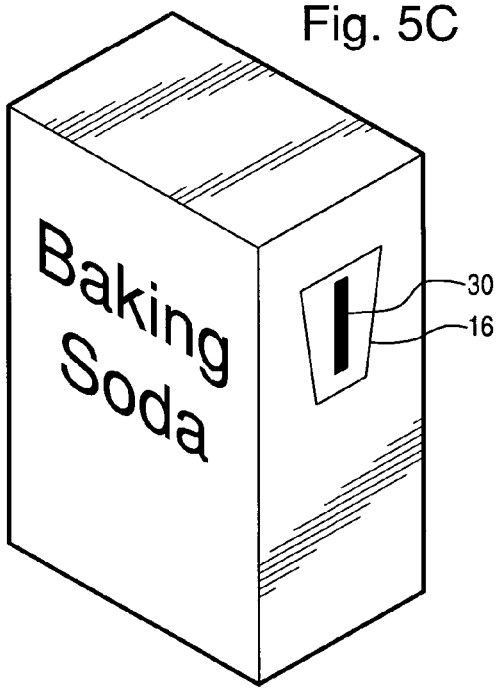

FIG. 5A-C shows a series of schematics representing ink or dye progression at various stages of migration, as seen through a viewing window area 30 in the display segment 6 (see FIGS. 1, 2, and 4) of the time indicator 2. In general, the ink or dye migrates from the legs of the V shaped printed ink pattern (not shown) both vertically and laterally into and through the non-curing ink or dye permeable polymer layer (not shown). The ink or dye migration can be viewed as lateral progression from the base or bottom of the viewing window area 30 to the top of the viewing window area 30. FIG. 5A represents an early stage of the ink or dye migration, where the ink or dye has migrated approximately ⅓ of the way from the base or bottom of the viewing window area 30 to the top of the viewing window area 30 of the time indicator 2. FIG. 5B represents ink or dye migration approximately ⅔ of the way from the base or bottom of the viewing window area 30 to the top of the viewing window area 30 of the time indicator 2. And FIG. 5C represents expiration of the timing period or predetermined period of time, as shown by migration of the ink or dye to the upper most edge of the viewing window area 30. As shown, time indicator 2 is attached to the surface of a baking soda box.

Figure 6A:
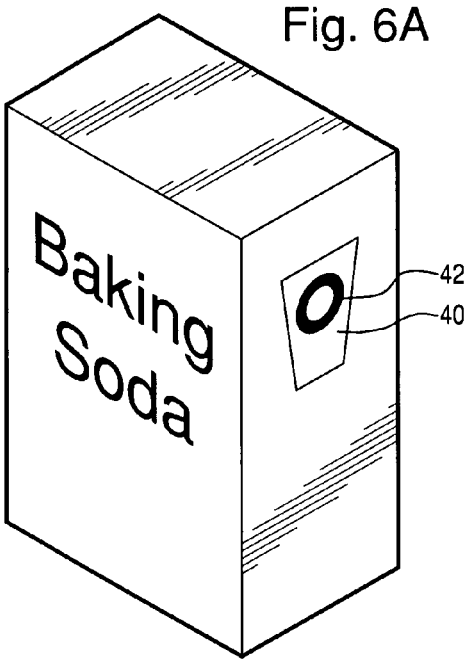
FIG. 6A-C is a series of schematics showing ink or dye progression at various stages of migration, as seen through a circular viewing window of a time indicator in accordance with one embodiment of the present invention.
Figure 6B:
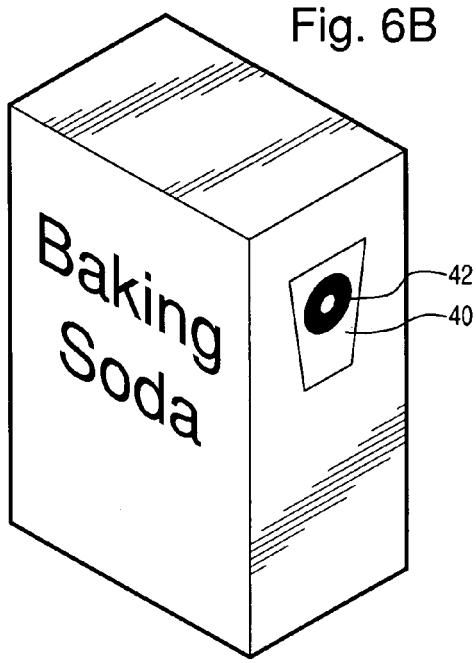
Figure 6C:
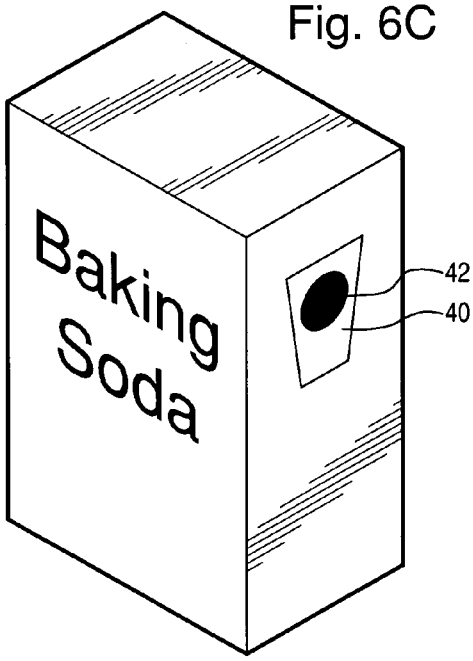

FIG. 6A-C shows a series of schematics representing ink or dye progression at various stages of migration in a second embodiment of the time indicator of the present invention. In this embodiment, ink or dye migration can be viewed and followed through a circular shaped viewing window area 42 in the display segment 40 of a time indicator. In this embodiment, the printed migrating ink or dye area (see, e.g., printed migrating ink or dye area 14 of FIG. 2) is printed in a ring shaped pattern (not shown). The ink or dye migrates from the ring shaped printed ink or dye pattern (not shown) both vertically and laterally into and through the non-curing ink or dye permeable polymer layer (not shown). FIG. 6A represents an early stage of the ink or dye migration, where the ink or dye has migrated approximately ⅓ of the way from the outer edge of the circular shaped viewing window area 42 to the center of circular shaped viewing window area 42 of the time indicator. FIG. 6B represents ink or dye migration approximately ⅔ of the way from the from the outer edge of the circular shaped viewing window area 42 to the center of circular shaped viewing window area 42 of the time indicator. And FIG. 6C represents expiration of the timing period or predetermined period of time, as shown by migration of the ink or dye to the center of the circular shaped viewing window area 42, filling the entire circular shaped viewing window area 42 with ink or dye. As shown, the time indicator is attached to the surface of a baking soda box.

Figure 7A:
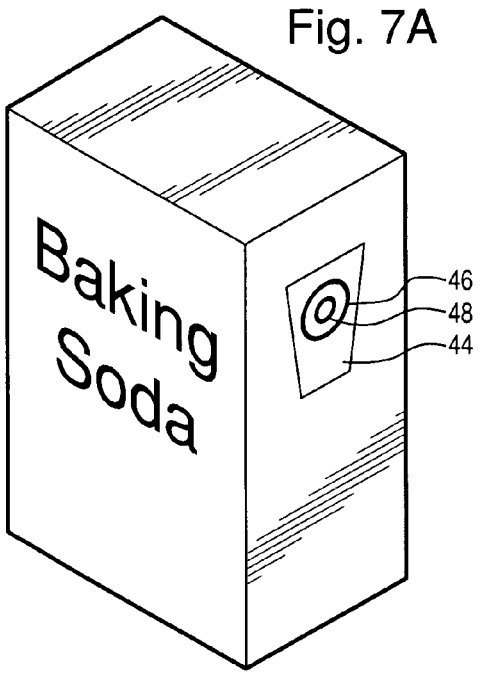
FIG. 7A-C is a series of schematics showing ink or dye progression at various stages of migration, as seen through a circular viewing window of a time indicator in accordance with a second embodiment of the present invention.
Figure 7B:
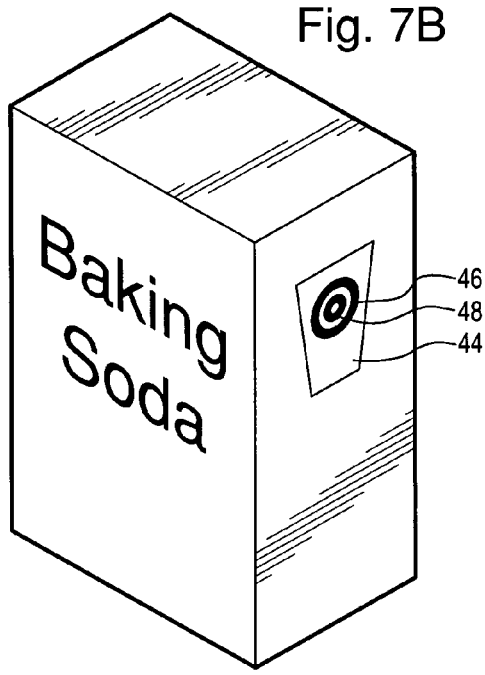
Figure 7C:
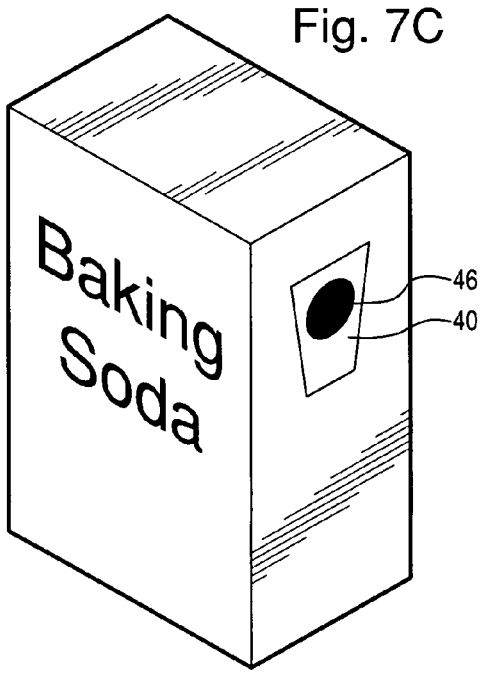

FIG. 7A-C shows a series of schematics representing ink or dye progression at various stages of migration in a third embodiment of the time indicator of the present invention. In this embodiment, ink or dye migration can be viewed and followed through a circular shaped viewing window area 46 in the display segment 44 of a time indicator. In this embodiment, the printed migrating ink or dye area (see, e.g., printed migrating ink or dye area 14 of FIG. 2) is printed as two concentric ring shaped patterns, one inside of the other (not shown). The ink or dye migrates from both ring shaped printed ink or dye patterns (not shown) vertically and laterally into and through the non-curing ink or dye permeable polymer layer (not shown). The ink or dye migrates from an outer or larger ring shaped pattern (not shown) toward the center of circular shaped viewing window area 46 and from an inner or smaller circle both toward and away from the center of circular shaped viewing window area 46. Migration of the ink or dye from the inner or small ring both toward and away from the center of the circular shaped viewing window area 46 is represented herein as ink or dye migration 48. FIG. 7A represents an early stage of the ink or dye migration, where the circular shaped viewing window area 46 is approximately ⅓ filled in with ink or dye. FIG. 7B represents ink or dye migration, where the circular shaped viewing window area 46 is approximately ⅔ filled in with ink or dye. And FIG. 7C represents expiration of the timing period or predetermined period of time, as shown by the entire circular shaped viewing window area 46 being filled in by ink or dye. As shown, the time indicator is attached to the surface of a baking soda box.

The foregoing description and drawings are intended to be illustrative and explanatory of the invention, but are not the only means of obtaining the advantages of the invention. Numerous changes and alternations will occur to those of ordinary skill in the art in view of the present application and/or practice with the invention. Therefore, the foregoing description and drawings should be considered to be illustrative and exemplary of the invention within the scope of the claims.

The time indicator of this invention has many uses, including, but not limited to: a self-timing sticker for visual validation of an access card; a safety sticker that develops warning words such as "Dangerous" after specific time intervals; a self-timing retail sticker that voids itself; a time temperature food spoilage indicator; an indicator sticker for biological industrial processes, laboratory experiments, field testing, etc.; where a clock or timer is impractical or too expensive; a service sticker that shows words such as "Service Required" after a service or preventative maintenance time interval; a property pass, luggage tag, or bar coding sticker that self-expires to prevent re-use; a shipping sticker that changes color to flag urgent or dated shipments that are overdue or about to be missed; an identification-admission bracelet that self-expires after a time interval; a ski ticket or entertainment park pass that self-expires; a toll book, bus or train pass, that develops the word "expired" after a specific time interval.

What is claimed is:

1. A time indicator for visually determining the passage of a predetermined period of time comprising:

(a) a multi-layered base segment comprising a base impermeable support layer and a migrating ink or dye printed on the upper surface of said base impermeable support layer;

(b) a multi-layered display segment adjacent to said base segment and containing a clear impermeable layer which is coated with a color print or opaque layer and which contains a viewing window area therein, through which progression of a migrating ink or dye can be monitored, wherein said viewing window is a non-coated area of said clear impermeable layer, said multi-layer display segment further comprising a non-curing ink or dye permeable polymer layer between said clear impermeable layer and said upper surface of said base impermeable support layer, and wherein said migrating ink or dye can migrate both vertically and horizontally from said printed ink or dye through said non-curing ink or dye permeable polymer layer; and (c) a removable impervious film between said multi-layer base segment and said multi-layer display segment, which prevents said migrating ink or dye from coming into contact with said non-curing ink or dye permeable polymer layer.

2. The time indicator of claim 1, wherein said multi-layered display segment further comprises a transparent protective top layer.

3. The time indicator of claim 2, wherein said clear impermeable layer of said multi-layered display segment contains an opaqueing agent.

4. The time indicator of claim 1, wherein said non-curing ink or dye permeable polymer layer contains an opaqueing agent.

5. The time indicator of claim 1, wherein said non-curing ink or dye permeable polymer layer further comprises an ink or dye migrating agent.

6. The time indicator of claim 1, wherein said time indicator is placed on a time sensitive consumer product.

7. The time indicator of claim 1, wherein said ink or dye is printed on a top surface of said base impermeable support layer in a pattern in the shape of a V.

8. The time indicator of claim 1, wherein said ink or dye is printed on a top surface of said base impermeable support layer in the shape of a ring.

9. The time indicator of claim 1, wherein said ink or dye is printed on a top surface of said base impermeable support layer as concentric ring shaped ink or dye patterns.

10. The time indicator of claim 1, wherein said color print and/or opaque layer is overcoated with a graphic layer.

11. A method for visually determining the passage of a predetermined period of time using a time indicator said method comprising:

(a) providing a time indicator comprising:

(i) a multi-layered base segment comprising base impermeable support layer and a migrating ink or dye printed on an upper surface of said base impermeable support layer;

(ii) a multi-layered display segment adjacent to said base segment and containing a clear impermeable layer which is coated with a color print or opaque layer and which contains a viewing window area therein, through which progression of a migrating ink or dye can be monitored, wherein said viewing window is a non-coated area of said clear impermeable layer, said multi-layer display segment further comprising a non-curing ink or dye permeable polymer layer between said clear impermeable layer and said upper surface of said base impermeable support layer; and (iii) a removable impervious film that prevents said migrating ink or dye of said base segment from coming into contact with said non-curing ink or dye permeable polymer layer; and (b) activating said time indicator by removing said removable impervious film and bringing said printed migrating ink or dye and said non-curing ink or dye permeable polymer layer into contact with one another;

(c) monitoring the progression of said migrating ink or dye into and through said non-curing ink or dye permeable polymer layer through said viewing window area.

12. The method of claim 11, wherein said multi-layered display segment further comprises a transparent protective top layer.

13. The method of claim 12, wherein said non-curing ink or dye permeable polymer layer contains an opaqueing agent.

14. The method of claim 12, wherein said clear impermeable layer of said multi-layered display segment contains an opaqueing agent.

15. The method of claim 12, wherein said non-curing ink of dye permeable polymer layer further comprises and ink or dye migrating agent.

16. The method of claim 12, wherein said time indicator is placed on a time sensitive consumer product.

17. The method of claim 12, wherein said ink or dye is printed on a top surface of said base impermeable support layer in the shape of a V.

18. The method of claim 12, wherein said ink or dye is printed on a top surface of said base impermeable support layer in the shape of a ring.

19. The method of claim 12, wherein said ink or dye is printed on a top surface of said base impermeable support layer as concentric ring shaped ink or dye patterns.

20. The method of claim 12, wherein said color print and/or opaque layer is overcoated with a graphic layer.

* * * * *